US006475408B1

(12) United States Patent
Denis et al.

(10) Patent No.: US 6,475,408 B1
(45) Date of Patent: Nov. 5, 2002

(54) SHEAR-STABLE MIST-SUPPRESSING COMPOSITIONS

(75) Inventors: Richard A. Denis, Auburn Township, Geauga County, OH (US); Sanjay Kalhan, Richmond Heights, OH (US); Robert E. Quinn, Cleveland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 162 days.

(21) Appl. No.: 09/672,596

(22) Filed: Sep. 28, 2000

(51) Int. Cl.[7] ..... C09K 3/00

(52) U.S. Cl. ..... 252/194; 508/390; 508/404; 516/58; 516/59; 516/60; 516/66

(58) Field of Search ..... 252/194; 508/390, 508/404; 76/58, 59, 60, 66

(56) References Cited

U.S. PATENT DOCUMENTS

| | | | | |
|---|---|---|---|---|
| 3,833,502 A | | 9/1974 | Leary et al. | 252/49.5 |
| 3,855,135 A | * | 12/1974 | Newingham | 508/297 |
| 4,432,881 A | | 2/1984 | Evani | 252/8.5 |
| 4,493,777 A | | 1/1985 | Snyder, Jr. et al. | 252/49.3 |
| 4,520,182 A | | 5/1985 | Turner et al. | 526/307.2 |
| 4,563,294 A | | 1/1986 | Geymayer et al. | 252/49.3 |
| 4,770,814 A | | 9/1988 | Rose et al. | 252/315.4 |
| 4,880,565 A | | 11/1989 | Rose et al. | 252/355 |
| 5,089,578 A | | 2/1992 | Valint et al. | 526/240 |
| 5,159,035 A | | 10/1992 | Evani | 526/240 |

FOREIGN PATENT DOCUMENTS

| | | | |
|---|---|---|---|
| EP | 0642571 | 7/1996 | |
| EP | 0 811 677 | 12/1997 | 173/2 |
| EP | 0921185 | * 6/1999 | |
| WO | WO 93/24601 | 12/1993 | |
| WO | WO 99/6004 | 12/1999 | |

OTHER PUBLICATIONS

D. G. Peiffer et al., Polymer, 29, 716, 1988 ("Synthesis, solution viscosity and interfacial properties of random copolymers spanning a broad range of anionic characters").
P. L. Valint et al., Macromolecules, 21, 175–179, 1988 ("Synthesis and Characterization of Hydrophobically Associating Block Polymers").

* cited by examiner

*Primary Examiner*—Cephia D. Toomer
(74) *Attorney, Agent, or Firm*—David M. Shold; Michael F. Esposito

(57) ABSTRACT

Aqueous metal working fluids containing a water-soluble mist suppressing copolymer are disclosed. The copolymer includes styrene or hydrocarbyl-substituted styrene hydrophobic monomers and hydrophilic monomers. Optionally, the metal working fluid can be an oil-in-water emulsion.

26 Claims, No Drawings

SHEAR-STABLE MIST-SUPPRESSING COMPOSITIONS

BACKGROUND OF THE INVENTION

This invention relates to fluids comprising water and a mist suppressing copolymer. Optionally, the fluid can be an oil-in-water emulsion, including oil and an emulsifier. In addition to the mist suppressing copolymer, metal cutting operations and other high-shear operations often involve a work piece which rotates at relatively high speed, and a cutting tool, both of which are lubricated by a metal working fluid. Under these conditions, the metal working fluid is frequently thrown from the surface of the metal in the form of droplets. Often the droplets are small enough to be classified as a mist. Misting, or the formation of a mist, is considered undesirable because it represents a loss of the cutting fluid and because the cutting fluid mist is considered a contaminant in the air around the cutting machine.

Various polymers are known to thicken aqueous materials.

European Patent Application EP 811 677, published Dec. 10, 1997, discloses aqueous metal working fluids containing a mist suppressing copolymer which includes hydrophobic and hydrophilic monomers. The hydrophobic monomer is an alkyl substituted acrylamide or an acrylate ester. The hydrophilic monomer is an acrylamido sulfonic acid, an acrylamido disulfonic acid, or a styrene sulfonic acid.

PCT Publication WO 9966004, Dec. 23, 1999, discloses methods of using an aqueous composition containing a water-soluble or water-dispersible synthetic polymer which comprises a polymer formed by polymerizing (A) a hydrophobic monomer selected from the group consisting of an alkyl substituted acrylamide and an acrylate ester; and (B) a hydrophilic monomer selected from the group consisting acrylamido sulfonic acids and a styrene sulfonic acid. Optionally (C) monomers may be incorporated, including vinyl monomers such as vinyl acetate, N-vinyl-2-pyrrolidinone, N-vinyl caprolactam, 4-vinyl pyridine, and styrene.

D. G. Peiffer et al, *Polymer*, 29, 716, 1988 ("Synthesis, solution viscosity and interfacial properties of random copolymers spanning a broad range of anionic character") discloses polymers of styrene and Na-AMPS and discusses their solubility and viscosity behavior in various solvents including water.

Polymeric anti-misting additives reduce the misting of machine fluids at the source by stabilizing them against break-up during the extreme shear conditions which occur during metal working and similar operations. High molecular weight poly(ethylene oxide) is commonly used in this application. A typical polymer is POLYOX® available from Union Carbide. Typically, these polymers have a molecular weight from 1 to 2 million. However, these polymers are susceptible to shear. Metal working application often involve high shear, and as a result, metal working fluids containing high molecular weight poly(ethylene oxide) often suffer in performance when subjected to shear. Such degradation results when high shear conditions cause high molecular weight poly(ethylene oxide) to break down and lose its ability to suppress mist formation. In such high shear applications, the polymer must be replenished frequently.

The present invention, therefore, among other advantages, solves the problem of providing a water-soluble anti-mist additive for metal working fluid compositions and other high shear applications, which is resistant to degradation by shear. In one embodiment, the additive imparts properties to the composition such that the resultant composition sustains a shear rate range of from about 1 to about 1,000,000 $s^{-1}$, and sustains a shear stress range of from about 1 pascal to about 500,000 pascals. The word "sustain" or "sustains" as used herein means that the compositions of the present invention have the ability to survive a shear rate range of from about 1 to about 1,000,000 $s^{-1}$ and a shear stress range of from about 1 pascal to about 500,000 pascals over a period of time in a spraying application, beginning at a point before the composition is discharged and ending at the moment the composition is discharged. The word "survive" means the composition maintains its mist control properties from the point before discharge to the point after discharge such that effective mist control is achieved. The phrase "effective mist control" means that about 10% to about 100% mist reduction is achieved by the composition during and after discharge.

High shear applications other than metal working applications which can benefit from the present invention include applications of inks and coatings by spray and other technologies; application of deicing or anti-icing compositions; use of hydro-metallurgy/electro-winning compositions; use and application of cleaner compositions, such as household or industrial cleaner compositions; application of adhesive compositions; application of fire extinguishing compositions; application of personal care product compositions, including hand lotions, body creams, soaps, suntan lotions, hair conditioners, aftershave lotions, lip balms, cold creams, bubble bath, cleansing lotions, hairspray, deodorants, and perfumes; application of textile finish compositions, such as textile knitting fluid compositions or fiber finishing formulations; use of water-based hydraulic fluids; use of latex and other waterborne compositions; and dust control during mining operations.

SUMMARY OF THE INVENTION

The present invention provides a method for reducing mist formation in a high shear aqueous system which involves application of an aqueous composition to said high shear system, comprising: including in said aqueous composition, a water-dispersible, mist suppressing copolymer comprising (A) hydrophobic monomer units comprising at least one ethylenically unsaturated hydrocarbon or such hydrocarbon having a hydrocarbyl substituent, said monomer units containing 3 to 30 carbon atoms; and (B) hydrophilic monomer units comprising at least one polymerizable sulfonic acid or salt thereof.

The present invention further provides a method for lubricating a metal workpiece in a cutting operation, comprising: supplying to said workpiece a composition comprising (a) water and (b) a water-dispersible, mist suppressing copolymer comprising (A) hydrophobic monomer units comprising at least one ethylenically unsaturated hydrocarbon or such hydrocarbon having a hydrocarbyl substituent, said monomer units containing 3 to 30 carbon atoms; and (B) hydrophilic monomer units comprising at least one polymerizable sulfonic acid or salt thereof.

The present invention further provides an oil-in-water emulsion comprising water, oil dispersed therein, and the above copolymer.

DETAILED DESCRIPTION OF THE INVENTION

COPOLYMER

The anti-misting aqueous compositions contain a copolymer which is formed by the copolymerization of a hydrophilic monomer, often a water-soluble monomer, and a hydrophobic monomer, often a water-insoluble monomer. The hydrophobic monomer units comprise at least one ethylenically unsaturated hydrocarbon or such hydrocarbon having a hydrocarbyl substituent. The hydrophobic monomer units contain 3 to 30 carbon atoms, preferably 6 to 24 or 8 to 18 carbon atoms.

The hydrophobic monomer can be an olefin, and preferably an alpha olefin, of 6 to 18 carbon atoms. Aliphatic alpha olefins of this type include 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, and 1-octadecene, including both linear isomers and branched isomers such as 2-ethylhex-1-ene, and mixtures of linear and branched olefins as may be commercially available.

The ethylenically unsaturated hydrocarbon can also be styrene (which can also be considered an alpha olefin) or any of the hydrocarbyl-substituted styrenes. Such materials can typically be represented by the formula

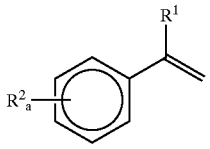

In the foregoing structure, $R^1$ is hydrogen or a hydrocarbyl group, $R^2$ is a hydrocarbyl group, and "a" is zero through 5, preferably zero or 1. $R^1$, if it is a hydrocarbyl group, and $R^2$ will each preferably contain 1 to 18 carbon atoms, more preferably 1 to 12, and still more preferably 1 to 4, and the total number of carbon atoms in all such hydrocarbyl substituents will be zero to 3, preferably 0 or 1, and more preferably 0. In addition to the structure shown, with the $R^1$ group on the β carbon, it is also possible to have a hydrocarbyl group on the α carbon of the double bond. Such materials are intended to be encompassed by the present invention, although they may be less desirable due to the reduced polymerization activity of materials containing only internal ethylenic bonds. Similarly, the expresion "hydrocarbyl-substituted styrene" is intended to encompass structures in which the $R^2$ group provides a fused ring structure, that is, in which the overall material is a vinyl naphthalene compound or a hydrocarbyl-substituted derivative thereof. In the latter case, the value of "a" can be up to the number of replaceable hydrogen atoms on the ring structure. Among these alternatives, styrene itself is a preferred monomer.

In the polymerization reaction the ethylenic bonds in the styrene or other olefinic monomer and in the hydrophilic monomer polymerize, and the resulting polymer consists of a polyethylene-type backbone with hydrophilic and hydrophobic side chains.

HYDROPHILIC MONOMERS

The hydrophilic monomers usable in the present invention are polymerizable sulfonic acids or salts, such as acrylamido or methacrylamido sulfonic acids represented by the formula:

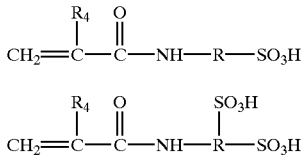

B(I)

or

B(II)

and salts thereof; wherein $R_4$ is a hydrogen or a methyl group and R is an aliphatic or aromatic hydrocarbon group typically containing 2 to 8 carbon atoms. The R group can be branched, as in the molecule 2-acrylamido-2-methylpropane sulfonic acid which has the following structure:

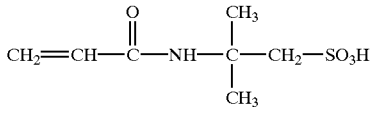

The R group can also include phenyl groups, alkyl substituted phenyl groups and cycloaliphatic groups.

The salts are selected from the group consisting of alkali metal salts, alkaline earth metal salts, salts of the metals Sc, Ti, V, Cr, Mn, Fe, Co, Ni, Cu, Ce, and Zn, and ammonium salts. The ammonium ion can be represented by:

$$R_5R_6R_7R_8N^+$$

where $R_5$, $R_6$, $R_7$, and $R_8$ are independently hydrogen or hydrocarbyl groups. The term "ammonium" ion or salt, as used herein, is intended in a generic sense to include ammonium ions or salts in the strict sense, where $R_5$, $R_6$, $R_7$, and $R_8$ are each hydrogen, as well as amine ions or salts, where up to three of the R groups are hydrocarbyl groups, and quaternary ammonium ions or salts, where each of the R groups is a hydrocarbyl group. It is preferred that the total number of carbon atoms in an ammonium cation does not exceed 21 carbon atoms.

2-Acrylamido-2-methylpropanesulfonic acid and its salts are well known materials which are commercially available under the trade name AMPS® monomers. Such materials and their methods of preparation are disclosed, for instance, in U.S. Pat. No. 3,544,597.

Alternatively, the hydrophilic monomer can be a styrenic sulfonic acid or salts thereof, which terms include styrene sulfonic acids and styrene sulfonates as well as substituted styrene sulfonic acids and substituted styrene sulfonates. Such materials, in their salt form, are illustrated by the following formula:

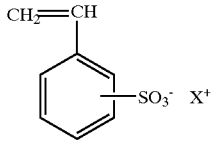

In the above structure, the $X^+$ is a cation which is preferably selected from the group consisting of alkali metal cations, alkaline earth cations, cations of the transition metals —Sc, Ti, V, Cr, Mn, Fe, Co, Ni, Cu, Ce, Zn, and ammonium ions, as described above.

Other suitable hydrophilic monomers include sulfoethyl methacrylate, isobutylenesulfonic acid, allylsulfonic acid, vinylsulfonic acid, and salts thereof.

The polymer of the present invention is water dispersible or water soluble. By this is meant that the polymer can be dispersed or dissolved in water in an amount of at least 50 parts per million, preferably at least 0.1 weight percent, and more preferably at least 1 weight percent or even 10 weight percent at room temperature, said solubility being preferably evaluated for the polymer itself, or alternatively the polymer with the aid of a surface active agent. The terms "dispersible" and "soluble" are used interchangeably in this context to indicated the observable macroscopic dispersion or solution of the polymer, without regard to the microscopic or molecular mechanism or structures which may be involved. In order to achieve this degree of solubility, a certain minimum amount of the hydrophilic monomer should be present. Preferably the ratio of moles of A, the hydrophobic monomer, to the moles of B, the hydrophilic monomer, should be 1:99 to 75:25. More preferred ranges for the moles of A to B are 5:95 or 10:90 to 50:50.

FORMATION OF THE COPOLYMER

The copolymer is produced by free radical polymerization. The polymerization is done by well-known free radical methods. The general properties of acrylamide polymers, as well as their methods of preparation are discussed in *The Encyclopedia of Polymer Science and Engineering*, Volume 1, John Wiley & Sons, 1985 (pp 169–211). The Encyclopedia discusses techniques useful in forming acrylic ester polymers (pp 265–273). The polymerization can be conducted in solution, and by various suspension or emulsion methods. In solution polymerization, a solvent is selected which allows both the hydrophilic and hydrophobic monomers to be maintained in solution. Mixtures of water, acetic acid, various low molecular weight alcohols such as, methanol, ethanol, and butyl alcohol, as well as polar solvents such as, acetone, acetic acid, tetrahydrofuran, dimethylsulfoxide, dioxane, dimethylformide and N-methyl-pyrrolidinone. A wide variety of free radical sources can be used as initiators including persulfates, redox couples, azo compounds and the like. In particular, emulsion polymerization methods can be used to form polymers useful in the present invention. The preferred method of polymerization is solution polymerization and is illustrated in the following examples.

POLYMER PREPARATION

Example 1. A 250 mL resin flask is fitted with an overhead stiffer, a condenser, and a nitrogen gas adapter. The flask is charged with 13.6 g styrene, 30 g of the sodium salt of 2-acrylamido-2-methylpropanesulfonic acid, 30 g dimethylformamide, and 1 g azobisisobutyronitrile ("AIBN") initiator. The mixture is heated to 55° C. under a nitrogen purge of 28 L/hr (1 std. $ft^3$/hr.) with slow stirring. The mixture is maintained under these conditions for 8 hours, whereupon 105 g water is added, and stirring continued at 55° C. for an additional 8 hours. The contents of the flask are transferred to a crystallizing dish and dried at 100° C. under vacuum for 20 hours to provide the solid polymeric product.

Example 2. To a 250 mL resin flask, equipped as in Example 1, is charged 6.5 g (57 mmol) 1-octene, 40 g (175 mmol) solid sodium salt of 2-acrylamido-2-methylpropanesulfonic acid, 40 g of dimethylsulfoxide, and 0.0088 g (0.05 mmol) AIBN initiator. A nitrogen purge is started at 25 L/hr (0.5 std. $ft^3$/hr.) and the contents heated to 67° C. After 25 minutes of stirring the mixture becomes viscous, and 32 g water are added, and after an additional hour of stirring, an additional 20 g water. After yet an another hour of stirring, 0.008 g additional AIBN is added and the mixture is stirred at 67° C. for another 2.5 hours. The contents of the flask are poured into a crystallizing dish and the product is dried at 110° C. under (10 mm Hg) vacuum for 16 hours to provide 44.4 g product.

TESTING

In order to evaluate the performance of the inventive polymers, a method is employed for evaluating a polymer's ability to reduce mist formation. This method involves a "grinder antimist test," which has also been described in U.S. patent application Ser. No. 09/473068, filed Dec. 28, 1999. The test apparatus comprises of a partially enclosed Boyar Schulz surface grinder, in which a 152 mm (6") wide×1.3 mm (½") thick resin bonded medium grit wheel is used to machine a 1018 steel bar 2.5 mm×2.5 mm×152 mm (1"×1"×6") at 3000 rpm. A gear pump is used to recirculate diluted metalworking fluid in the system and feed the metalworking fluid from a 19 L (5 gallon) capacity sump to the workpiece/grinding wheel interface at approximately 7.6 L/min (2 gpm) flow rate and 550 kPa (80 psi) pressure through a 3.2 mm (⅛") nozzle. The grinding wheel/workpiece is enclosed within a 0.034 $m^2$ (1.2 $ft^3$) Plexiglas™ enclosure to capture and localize the mists produced during grinding.

A portable, real time aerosol monitor DataRAM® [MIE Instruments Inc., Bedford Mass.] is used to continuously quantify the mist levels generated from the diluted end use metalworking fluid inside the grinder enclosure. The sampling probe is set at a height of 1.4 m (5.5') in the enclosure. The air sampling in the grinder experiment is done under stagnant conditions so as to exaggerate and maximize the mist concentrations in the enclosure.

The DataRAM is a nephelometric monitor used to measure airborne particle concentration by sensing the amount of light scattered by the population of particles passing through a sampling volume. During its operation, a discrete amount of air volume (at 2 liters/minute) is illuminated by a pulsed light emitting diode with the narrow band at 880 nm. The concentration of airborne particulate is then measured based upon the response of a silicon detector hybrid amplifier unit to the forward-scattered light intensity. The DataRAM provides concentration measurement ranges from 0.0001 mg/$m^3$ to 400 mg/$m^3$ (as Arizona dust primary standard calibration).

Mist concentration generated by an end use metalworking fluid without any polymer is first used to establish a baseline. The grinding test consists of an idling cycle where the recirculating metalworking fluid is sprayed on the revolving wheel/steel workpiece interface for 15 minutes [Step A]. Following the idling cycle, grinding is initiated in which the steel piece surface is machined in incremental sweeps of 0.39 mm (0.001") for a period of 30 minutes [Step B]. The sequence of steps A and B is repeated twice with the end use metalworking fluid (without the polymer) to establish baseline mist levels.

After establishing baseline mist levels, the metalworking fluid in the grinder sump is treated with the polymer to be tested. The sequence of ambient air sampling of idling and grinding steps A and B, as described above, is repeated under identical grinding and mist sampling conditions as used for the baseline. The mist reduction performance derived from the polymers present in the metalworking fluids is calculated by comparing mist levels generated of the baseline metalworking fluid (without polymer) with those treated with the antimist polymer.

The amount of mist reduction (% antimist or % mist reduction) performance achieved (exhibited) from candidate antimist polymers is calculated as follows:

% mist reduction=(mist concentration after polymer addition/mist concentration before polymer addition)×100

Water, which can be atomized relatively easily into a fine mist, produces the largest diameter pattern. When a known mist suppressant, POLYOX®, is added to the water, a large reduction in the pattern diameter is observed. Similarly, the polymer disclosed herein is dissolved in water and found to substantially reduce the diameter of the spray patterns produced on the screen. A reduction of 52% is observed for the polymer prepared in Example 2 above.

COMPOSITIONS

The metal working fluids of the present invention include aqueous based, oil-free compositions. In their simplest form, these compositions include water, and the antimisting polymer. It is desirable to include the polymer at a level which is effective to suppress mist. However, even with recovery of used metal working fluids some is lost in use and the antimisting polymer is an expense. Accordingly, it is also desirable to use the antimisting polymers at the lower levels of their effective concentration range. Many factors affect the level of polymer required to achieve an antimisting effect. The shape of the tool and the work piece, the shear level in the particular application, and the rate of movement of the workpiece all influence the amount of mist suppression required. The antimisting polymer is typically used in a concentration range of as low as 0.005 weight percent up to 10 weight percent, preferably 0.02 to 1 weight percent, and more preferably 0.05 to 0.1 weight percent based upon the total weight of the composition. A mixture of the antimisting polymers can also be used to prepare the compositions.

In addition to the antimisting polymer, the aqueous metal working fluids can contain additives to improve the properties of the composition. These additives include anti-foam agents, metal deactivators, and corrosion inhibitors, antimicrobial, anticorrosion, extreme pressure, antiwear, antifriction, and antirust agents. Such materials are well known to those skilled in the art.

The metal working fluids of the present invention can also be oil-in-water emulsions. The emulsion compositions contain the same types and amounts of antimisting polymers as the purely aqueous compositions discussed above. The compositions can also contain the property improving additives which have been used in the purely aqueous fluids noted above.

The oils used in the emulsion compositions can include petroleum oils, such as oils of lubricating viscosity, crude oils, diesel oils, mineral seal oils, kerosenes, fuel oils, white oils, and aromatic oils. Liquid oils include natural lubricating oils, such as animal oils, vegetable oils, mineral lubricating oils, solvent or acid treated mineral oils, oils derived from. coal or shale, and synthetic oils. Synthetic oils include hydrocarbon oils and halo-substituted hydrocarbon oils such as polymerized and interpolymerized olefins, for example polybutylenes, polypropylenes, propylene-isobutylene copolymers, chlorinated polybutylenes, poly(1-hexenes), poly(1-octenes), poly(1-decenes); alkyl benzenes, such as dodecylbenzenes, tetradecylbenzenes, dinonylbenzenes, di-(2-ethylhexyl)-benzenes; polyphenyls such as biphenyls, terphenyls, and alkylated polyphenyls; and alkylated diphenyl ethers and alkylated diphenyl sulfides and derivatives, analogs and homologs thereof.

Alkylene oxide polymers and derivatives thereof where terminal hydroxy groups have been modified such as by esterification or etherification constitute another class of synthetic oils. These are exemplified by polyoxyalkylene polymers prepared by the polymerization of ethylene oxide or propylene oxide, the alkyl and aryl ethers of these polyoxyalkylene polymers such as methyl-polyisopropylene glycol ethers, diphenyl and diethyl ethers of polyethylene glycol; and mono and polycarboxylic esters thereof, for example, the acetic esters, mixed $C_3$–$C_8$, fatty acid esters and $C_{13}$ O×O diester of tetraethylene glycol. Simple aliphatic ethers can be used as synthetic oils, such as, dioctyl ether, didecyl ether, di(2-ethylhexyl) ether.

Another suitable class of synthetic oils comprises the esters of fatty acids such as ethyl oleate, lauryl hexanoate, and decyl palmitate. The esters of dicarboxylic acids such as phthalic acid, succinic acid, maleic acid, azelaic acid, sebacic acid, fumaric acid, adipic acid, linoleic acid dimer, malonic acid, alkyl malonic acids, alkenyl malonic acids with a variety of alcohols such as butyl alcohol, hexyl alcohol, dodecyl alcohol, 2-ethylhexyl alcohol, ethylene glycol, diethylene glycol monoethyl ether, propylene glycol. Specific examples of these esters include dibutyl adipate, di(2-ethylhexyl) sebacate, di-n-hexyl fumarate, dioctyl sebacate, diisoctyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

The ratio of oil to water can typically vary from 1:5 to 1:200. Any oil-in-water emulsifier can be used to prepare the emulsions of the present invention. Emulsifiers can be single materials or can be mixtures of surfactants. Typical emulsifiers include alkali metal sulfonates and carboxylates, salts derived from the reaction product of carboxylic acylating agents with amines and hydroxylamines, polyols, polyether glycols, polyethers, and polyesters and the like. *The Kirk-Othmer Encyclopedia Chemical Technology* (3rd. Edition V. 8 pp. 900–930) provides a good discussion of emulsions and provides a list of emulsifiers useful in preparation of oil-in-water emulsions.

In the methods and composition of the present invention, the amount of the water-soluble mist suppressing copolymer will typically be 1 to 5000 parts per million (ppm) by weight of the composition, preferably 10 to 2000 ppm, and more preferably 100 to 1000 ppm by weight.

OTHER INGREDIENTS

A typical metal working fluid would include other components such as anti-foam agents, metal deactivators, corrosion inhibitors, antimicrobial, extreme pressure, antiwear, antifriction, and antirust agents. Typical anti-friction agents include overbased sulfonates, sulfurized olefins, chlorinated paraffins and olefins, sulfurized ester olefins, amine terminated polyglycols, and sodium dioctyl phosphate salts. Useful anti-foam agents include: alkyl polymeth-acrylates, and polymethylsiloxanes. Metal deactivators include materials such as tolyltriazole. Corrosion inhibitors include carboxylic/boric acid diamine salts, carboxylic acid amine salts, alkanol amines, alkanol amine borates and the like. These ingredients will be used in their conventional amounts.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to acidic or anionic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A method for reducing mist formation in a high shear aqueous system which involves application of an aqueous composition to said high shear system, comprising: including in said aqueous composition, a water-dispersible, mist suppressing copolymer comprising (A) hydrophobic monomer units comprising 1-octene; and (B) hydrophilic monomer units comprising at least one polymerizable sulfonic acid or salt thereof.

2. The. method of claim 1 wherein the ratio of moles of A to B is about 1:99 to 75:25.

3. The method of claim 1 wherein the hydrophilic monomer units of (B) are selected from the group consisting of sulfonic acids represented by the formulas:

B(I)

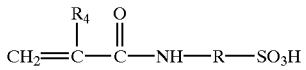

B(II)

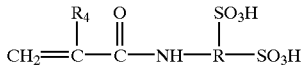

and

B(III)

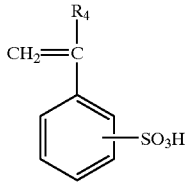

and salts thereof; wherein $R_4$ is a hydrogen or a methyl group and R is an aliphatic or aromatic hydrocarbon group containing 2 to about 12 carbon atoms; wherein the salts are selected from the group consisting of alkali metal salts, alkaline earth metal salts, salts of the metals Sc, Ti, V, Cr, Mn, Fe, Co, Ni, Cu Ce, and Zn, and ammonium salts, wherein the ammonium ion is represented by:

$$R_5R_6R_7R_8N^+$$

where $R_5$, $R_6$, $R_7$, and $R_8$ are independently hydrogen or hydrocarbyl groups, provided that the total number of carbon atoms in an ammonium cation does not exceed about 21 carbon atoms.

4. The method of claim 3 wherein the hydrophilic monomer comprises B(I).

5. The method of claim 4 wherein R contains 4 to 8 carbon atoms.

6. The method of claim 1 wherein the hydrophilic monomer unit comprises 2-acrylamido-2-methylpropane sulfonic acid sodium salt.

7. The method of claim 1 wherein the water-soluble mist suppressing copolymer comprises about 1 to about 5000 parts per million by weight of the composition.

8. A method for reducing mist formation in a high shear aqueous system which involves application of an aqueous composition to said high shear system, comprising: including in said aqueous composition, a water-dispersible, mist suppressing copolymer comprising (A) hydrophobic monomer units comprising at least one ethylenically unsaturated hydrocarbon or such hydrocarbon having a hydrocarbyl substituent, said monomer units containing 3 to about 30 carbon atoms; and (B) hydrophilic monomer units comprising at least one polymerizable sulfonic acid or salt thereof;

wherein said mist suppressing copolymer imparts aerosol control or particulate control in combination with shear stability to said fluid, whereby said composition sustains a shear rate range of from 1 to 1,000,000 $s^{-1}$, and sustains a shear stress range of from 1 Pa to 500,000 Pa.

9. A method for lubricating a metal workpiece in a cutting operation, comprising: supplying to said workpiece a composition comprising (a) water and (b) a water-dispersible, mist suppressing copolymer comprising (A) hydrophobic monomer units comprising linear or branched alpha olefins of 6 to about 18 carbon atoms; and (B) hydrophilic monomer units comprising at least one polymerizable sulfonic acid or salt thereof.

10. The method of claim 9 wherein the ratio of moles of A to B is about 1:99 to 75:25.

11. The method of claim 9 wherein the number of carbon atoms in the monomer units of (A) is 8 to about 18.

12. The method of claim 9 wherein the alpha olefin comprise 1-octene.

13. The method of claim 9 wherein the hydrophilic monomer units of (B) are selected from the group consisting of sulfonic acids represented by the formulas:

B(I)

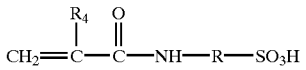

B(II)

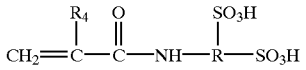

and

B(III)

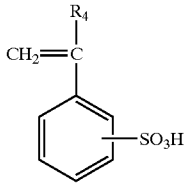

and salts thereof; wherein $R_4$ is a hydrogen or a methyl group and R is an aliphatic or aromatic hydrocarbon group containing 2 to about 12 carbon atoms; wherein the salts are selected from the group consisting of alkali metal salts, alkaline earth metal salts, salts of the metals Sc, Ti, V, Cr, Mn, Fe, Co, Ni, Cu Ce, and Zn, and ammonium salts, wherein the ammonium ion is represented by:

$$R_5R_6R_7R_8N^+$$

where $R_5$, $R_6$, $R_7$, and $R_8$ are independently hydrogen or hydrocarbyl groups, provided that the total number of carbon atoms in an ammonium cation does not exceed about 21 carbon atoms.

14. The method of claim 13 wherein the hydrophilic monomer comprises B(I).

15. The method of claim 13 wherein R contains 4 to 8 carbon atoms.

16. The method of claim 9 wherein the hydrophilic monomer unit comprises 2-acrylamido-2-methylpropane sulfonic acid sodium salt.

17. The method of claim 9 wherein the hydrophilic monomer unit comprises 2-acrylamido-2-methylpropanesulfonic acid sodium salt and the hydrophobic monomer unit comprises 1-octene.

18. The method of claim 9 wherein the water-soluble mist suppressing copolymer comprises about 1 to about 5000 parts per million by weight of the composition.

19. A method for lubricating a metal workpiece in a cutting operation, comprising: supplying to said workpiece a composition comprising (a) water and (b) a water-dispersible, mist suppressing copolymer comprising (A) hydrophobic monomer units comprising at least one ethylenically unsaturated hydrocarbon or such hydrocarbon having a hydrocarbyl substituent, said monomer units containing 3 to about 30 carbon atoms; and (B) hydrophilic monomer units comprising at least one polymerizable sulfonic acid or salt thereof;

wherein said mist suppressing copolymer imparts aerosol control or particulate control in combination with shear stability to said composition, whereby said composition sustains a shear rate range of from 1 to 1,000,000 $s^{-1}$, and sustains a shear stress range of from 1 pascal to 500,000 pascals.

20. An oil-in-water emulsion comprising water, oil, and a water-dispersible mist suppressing copolymer comprising:

(A) hydrophobic monomer units comprising 1-octene; and (B) hydrophilic monomer units comprising at least one polymerizable sulfonic acid or salt thereof.

21. The emulsion of claim 20 further comprising an emulsifier.

22. The emulsion of claim 20 wherein the hydrophilic monomer unit comprises a sulfonic acid represented by the formula

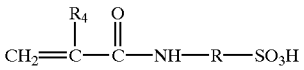

and salts thereof; wherein $R_4$ is a hydrogen or a methyl group and R is an aliphatic or aromatic hydrocarbon group containing 2 to about 12 carbon atoms; wherein the salts are selected from the group consisting of alkali metal salts, alkaline earth metal salts, salts of the metals Sc, Ti, V, Cr, Mn, Fe, Co, Ni, Cu Ce, and Zn, and ammonium salts, wherein the ammonium ion is represented by:

$$R_5R_6R_7R_8N^+$$

where $R_5$, $R_6$, $R_7$, and $R_8$ are independently hydrogen or hydrocarbyl groups, provided that the total number of carbon atoms in an ammonium cation does not exceed about 21 carbon atoms.

23. The emulsion of claim 22 wherein R contains 4 to 8 carbon atoms.

24. The emulsion of claim 22 wherein the hydrophilic monomer units comprise 2-acrylamido-2-methylpropane sulfonic acid sodium salt.

25. The emulsion of claim 20 wherein the water-soluble mist suppressing copolymer comprises about 1 to about 5000 parts per million by weight of the composition.

26. An oil-in-water emulsion comprising water, oil, and a water-dispersible mist suppressing copolymer comprising:

(A) hydrophobic monomer units comprising at least one ethylenically unsaturated hydrocarbon or such hydrocarbon having a hydrocarbyl substituent, said monomer units containing 3 to about 30 carbon atoms; and (B) hydrophilic monomer units comprising at least one polymerizable sulfonic acid or salt thereof;

wherein said mist suppressing copolymer imparts aerosol control or particulate control in combination with shear stability to said emulsion, whereby said fluid sustains a shear rate range of from 1 to 1,000,000 $s^{-1}$, and sustains a shear stress range of from 1 Pa to 500,000 Pa.

* * * * *